United States Patent [19]

Glowacki et al.

[11] 4,247,091

[45] Jan. 27, 1981

[54] ADJUSTABLE LABOR-DELIVERY-RECOVERY HOSPITAL BED

[75] Inventors: Gerald A. Glowacki, Glenarm; David E. Cage, Baltimore, both of Md.

[73] Assignee: Borg-Warner Corporation, Chicago, Ill.

[21] Appl. No.: 10,353

[22] Filed: Feb. 8, 1979

[51] Int. Cl.[3] ..... A61G 13/00

[52] U.S. Cl. ..... 269/325; 5/66

[58] Field of Search ..... 5/60, 66–69; 128/70, 361; 269/322–325, 328

[56] References Cited

U.S. PATENT DOCUMENTS

| | | | |
|---|---|---|---|
| 2,834,032 | 5/1958 | Scott | 5/69 X |
| 4,139,917 | 2/1979 | Fenwick | 269/325 X |

*Primary Examiner*—Robert C. Watson

*Attorney, Agent, or Firm*—James E. Gracy

[57] ABSTRACT

The same hospital bed may be employed for labor, delivery and recovery by providing two different adjustable back support sections in the mattress supporting structure. The expectant mother occupies the entire bed during labor and one back support, at the head end of the bed, may be tilted upward to raise the patient's back and head to maximize comfort. Prior to delivery, the patient is moved to the foot end of the bed and a second back support is tilted upward so that the patient will be held in a semi-sitting optimum position for delivery. The patient's legs may be held at a desired elevated level by a pair of crutches. In effect, the bed is convertible from a somewhat conventional hospital bed to an obstetrical table. After delivery, the second back support may be lowered so that the entire bed may then be used by the patient for recovery.

10 Claims, 9 Drawing Figures

FIG. 1
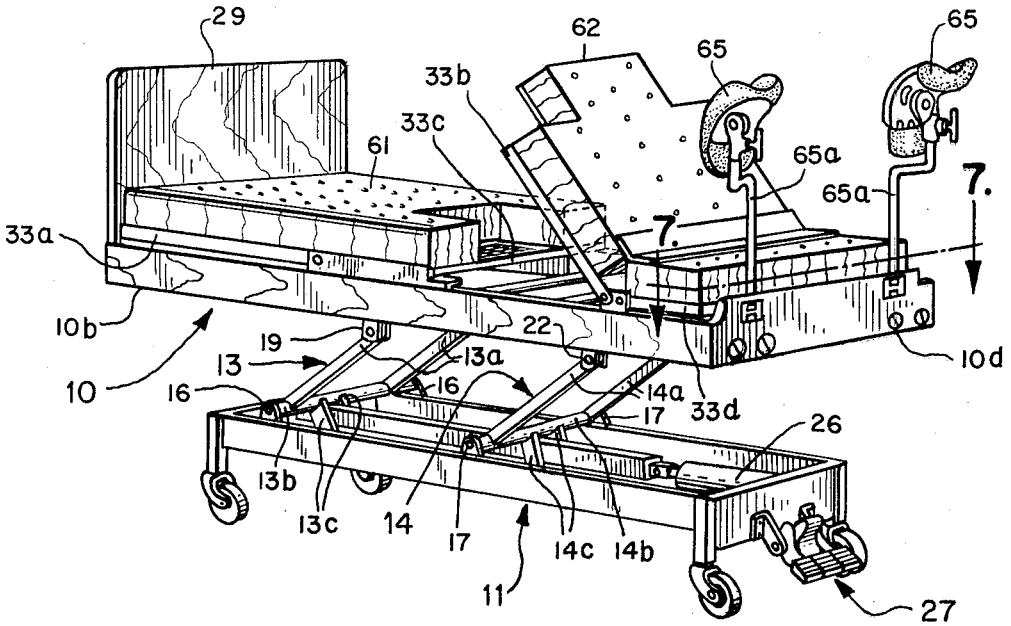
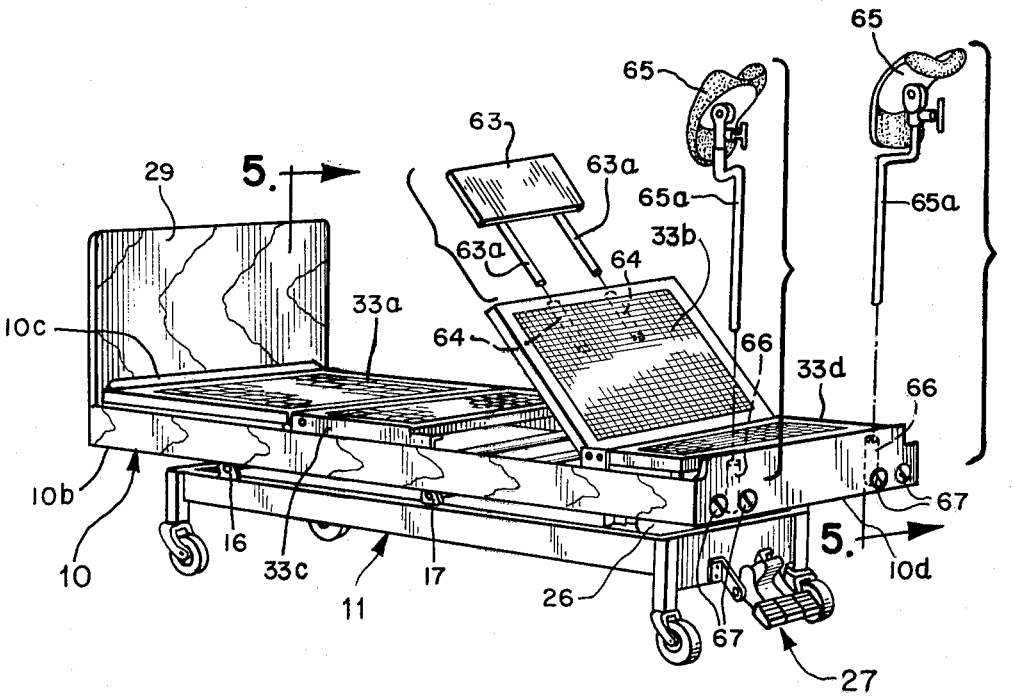
FIG. 2

ADJUSTABLE LABOR-DELIVERY-RECOVERY HOSPITAL BED

BACKGROUND OF THE INVENTION

This invention relates generally to a multi-function hospital bed and particularly to a birthing bed which will accommodate an expectant mother while she is in labor and also during the delivery process, after which the same bed may be used by the mother for recovery.

Childbirth in a hospital usually involves confining the pregnant patient in a bed in a labor room until she is ready for delivery, at which time she is moved into a delivery room and placed on an obstetrical table. After the child is born the patient is moved into another bed in a recovery room. The birthing bed of the present invention allows the expectant mother to remain in the same bed and in the same room from the time she is admitted until the time she leaves the hospital. Of course, such a concept improves efficiency substantially. Moreover, each birthing room, or labor-delivery-recovery room, may be decorated and furnished to create a home-like environment, thus enhancing the comfort for the patient. The birthing bed in a home-like atmosphere is particularly useful when natural childbirth occurs.

SUMMARY OF THE INVENTION

The present invention provides an adjustable multiple-use labor-delivery-recovery hospital bed to be used by a pregnant patient during the labor, delivery and recovery phases of childbirth. The bed comprises a frame on which is mounted a mattress supporting structure having, from its head end to its foot end and in the order named, a separate primary back support section, a separate secondary back support section, and a separate seat support section, the three support sections normally being coplanar. A first mattress overlies at least a major portion of the primary back support section and a second mattress overlies at least a major portion of the secondary back support section. The patient occupies substantially the entire bed and lies on both of the mattresses during labor, whereas when delivery is imminent she is moved to the foot end of the bed with her buttocks being supported by the seat support section. First adjusting means are provided for tilting the primary back support section upward so that the patient's back and head may be raised to the most comfortable position while she is in labor. Finally, the hospital bed comprises second adjusting means for tilting the secondary back support section upward in order to optimize the position of the patient for delivery.

DESCRIPTION OF THE DRAWINGS

The features of the invention which are believed to be novel are set forth with particularity in the appended claims. The invention, together with further advantages and features thereof, may best be understood, however, by reference to the following description in conjunction with the accompanying drawings in which like reference numbers identify like elements, and in which:

FIG. 1 is a perspective view of an adjustable labor-delivery-recovery hospital bed constructed in accordance with one embodiment of the invention and illustrating the configuration of the bed when used for delivery;

FIG. 2 is a perspective, partially exploded view of the same bed in a lowered position and also in the dellivery mode and with the mattresses removed;

DESCRIPTION OF THE ILLUSTRATED EMBODIMENT

Figure 3:
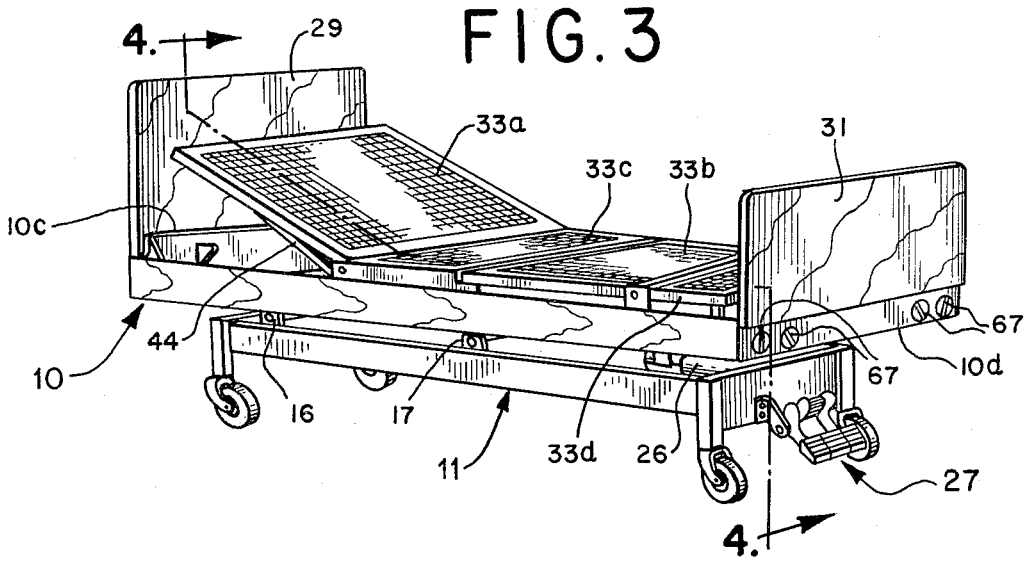
FIG. 3 is another perspective view of the bed of FIG. 1 without the mattresses and when the bed is established in either its labor or recovery operating modes.
Figure 7:
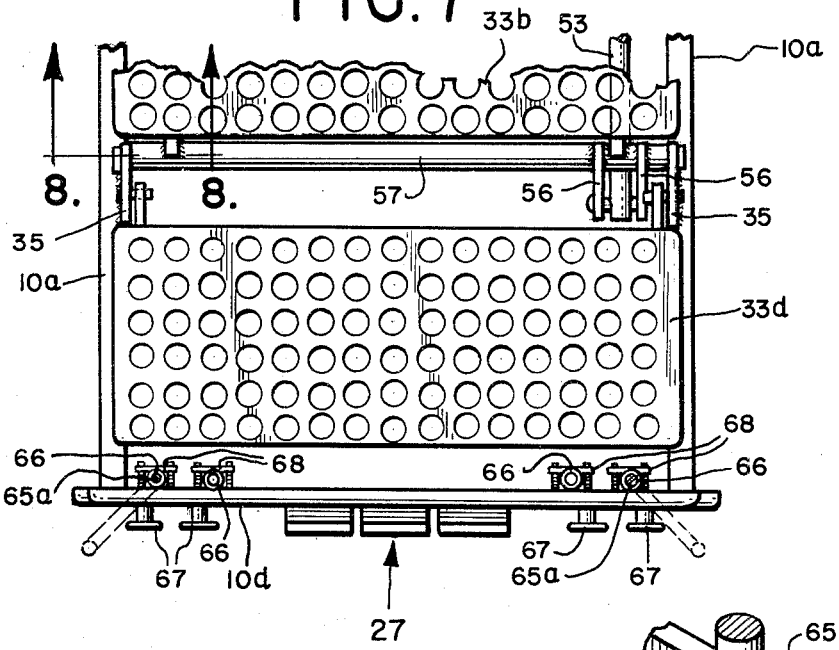
FIG. 7 is a fragmentary top view of the foot end of the bed.

The disclosed hospital bed includes a movable upper frame 10 which is supported on and is vertically adjustable with respect to a stationary lower base frame 11 by means of head and foot lift yokes 13 and 14, respectively, see particularly FIG. 1. The construction of the lift yokes and the apparatus, within base frame 10, for actuating them may take the form of that shown in detail in U.S. Pat. No. 3,222,693, issued Dec. 14, 1965 to Fred Pruim et al. Any appropriate elevating mechanism may be employed, however, for raising and lowering upper frame 10. Moreover, to practice the invention it is not even necessary that frame 10 be movable. Instead, the frame may be permanently held at a fixed level above the floor. As described in detail in the Pruim et at patent, head lift yoke 13 includes a pair of channel shaped long lever arms **13*a* rigidly affixed to a pivot tube 13*b* which in turn is rotatably mounted to a pair of brackets 16 rigidly secured to base frame 11. Yoke 13 also includes a pair of short lever arms 13*c* rigidly affixed to pivot tube 13*b*. Foot lift yoke 14 is of similar construction, having a pair of long lever arms 14*a* rigidly secured to a pivot tube 14*b* to which is also affixed a pair of short lever arms 14*c*. Pivot tube 14*b* is rotatably mounted to a pair of brackets 17 on frame 11**.

The upper or free ends of lever arms **13*a* pivotally connect to the lower ends of a pair of channel supports 19 (see FIG. 6) whose upper ends are rigidly affixed to a tube 21 which in turn is rigidly secured to a pair of L-shaped channels or side rails 10*a* included a movable frame 10. In similar fashion, the free ends of levers 14*a* are pivotally coupled to the lower ends of channel supports 22 the upper ends of which are rigidly secured to tube 23 whose ends are affixed to side rails 10*a*. With this arrangement, channel supports 19 and 22 will always be perpendicular with respect to the plane defined by side rails 10*a***.

As explained in the Pruim et at U.S. Pat. No. 3,222,693, lift yokes 13 and 14 are actuated by a reversible or bi-directional motor 26, supported on lower frame 11, that causes lever arms **13*c* and 14*c* to pivot simultaneously around tubes 13*b* and 14*b* respectively, thereby pivoting lever arms 13*a* and 14*a* at the same time to raise or lower channel supports 19 and 22 and consequently the upper frame 10. Any appropriate electrical circuitry (not shown) may be employed to control the energization of motor 26. For example, the circuitry shown in the Pruim et al patent may be used. Alternatively, the circuitry in either U.S. Pat. No. 3,921,048, issued Nov. 18, 1975 to Kenneth W. Padgitt or U.S. Pat. No. 3,993,940, issued Nov. 23, 1976 to Joseph A. Volk, Jr. may be used to control the rotation of motor 26 to select the desired elevation for frame 10. Operation of the circuitry is initiated and controlled by foot pedals 27 that may be manipulated by the doctor, nurse or attendant. Preferably, the patient occupying the bed will have a remote control device (such as shown in the aforementioned patents) for remotely controlling other adjustments of the bed to be described. Such a control device may either be held by the patient or removably attached to the bed. If desired, the remote control device may be made to also control the energization of motor 26** so that the patient can operate the high-low control.

As shown in the Pruim et al patent, the pedals 27 may also be depressed to establish the bed in either a trendelenburg or reverse-trendelenburg position. When the trendelenburg position is selected by actuating pedals 27, yoke 14 is pivoted more than yoke 13 causing the foot end of frame 10 to be higher than the head end. On the other hand, when reverse trendelenburg is selected, yoke 13 is pivoted to a greater extent than yoke 14 thereby raising the head end with respect to the foot end.

Frame 10 includes a pair of side boards **10*b* which attach to the side rails 10*a* in any convenient manner. For exammple, each of rails 10*a* may have brackets (not shown) at its extreme ends to which a side board 10*b* is removably attached. A head end panel 10*c* is rigidly affixed to side rails 10*a* at the head end of the bed and a foot end panel 10*d* is rigidly secured to the foot ends of side rails 10*a*. A head board 29 is removably attached to panel 10*c* and a foot board 31 is removably secured to panel 10*d*. When the bed is in the delivery mode (shown in FIGS. 1, 2, 5 and 6**) the foot board is removed.

A mattress supporting structure is mounted on frame 10. More specifically, the structure includes a separate primary back support sectin **33*a*, a separate secondary back support section 33*b* and a pair of separate seat support sections 33*c* and 33*d*. Each of the four support sections preferably takes the form of a perforated metal panel, but of course other constructions could be employed. For example, each mattress support section may constitute a bed spring. Seat support section 33*c* is rigidly affixed to side rails 10*a*, while seat support section 33*d* is pivotally mounted, along one of its sides, to a pair of brackets 35 rigidly secured to side rails 10*a*. When section 33*d* is in its normal position, shown in the drawings, its other side is supported on a pair of posts 36 rigidly affixed to side rails 10*a*. Section 33*d* is pivotally mounted so that it can be manually tilted upward to gain access to the apparatus and components, located beneath the section, for maintenance purposes. Although the electrical circuitry has been omitted in order to avoid encumbering the drawings, the major portion of that circuitry could be mounted on the inside of end panel 10*d*. Ease of servicing is facilitated by making section 33*d*** movable.

Figures 4, 5:
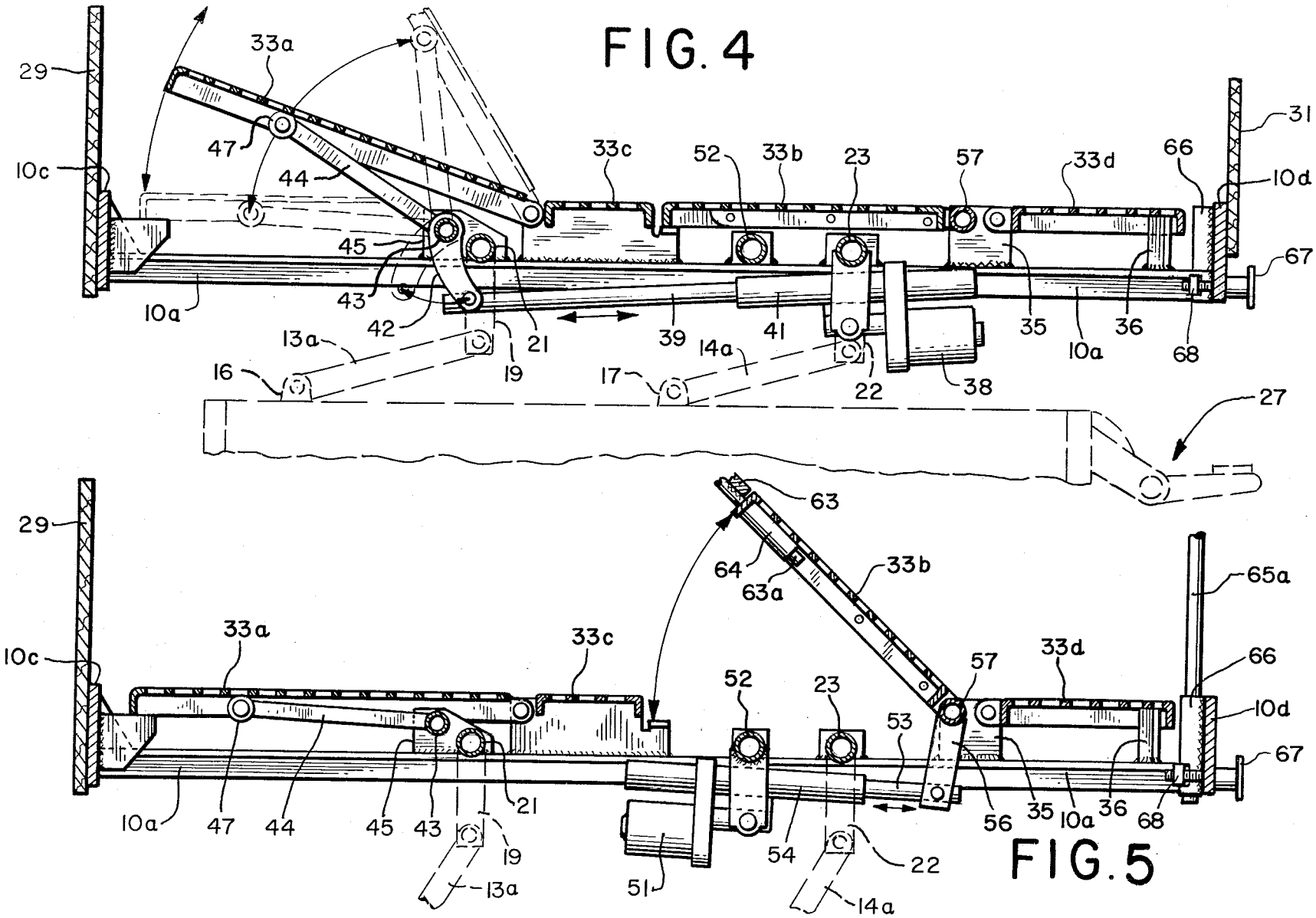
FIG. 4 is a fragmentary sectional view taken along the section line 4—4 in FIG. 3.
FIG. 5 is a fragmentary sectional view taken along the section line 5—5 in FIG. 2.
Figure 6:
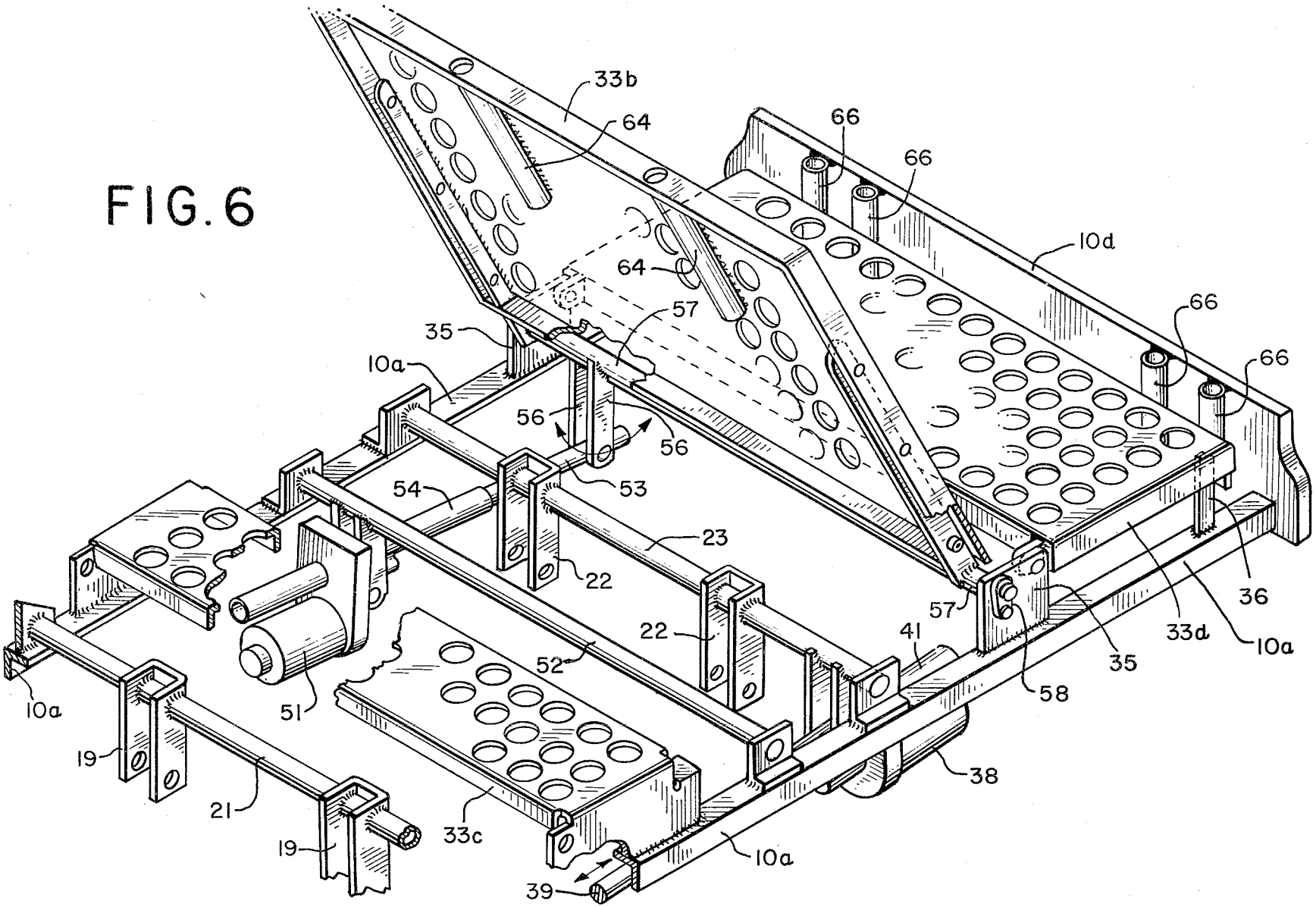
FIG. 6 is a fragmentary perspective view of the bed and illustrates the manner in which it is established in its delivery operating mode.

Primary back support section **33*a* and its adjusting means for tilting it are similar to that shown in the Pruim et al patent. As best seen in FIGS. 4 and 6, a bi-directional or reversible motor 38 is supported by and hung from tube 23. When energized the motor drives the inner telescoping tube 39 axially within the outer tube 41. The free end of tube 39 is pivotally coupled to a short lever arm 42 which is rigidly affixed to a pivot tube 43 to which a pair of long lever arms 44 (only one being shown) are also rigidly affixed. Tube 43 is pivotally mounted to a pair of brackets 45 rigidly secured to side rails 10*a*. A roller 47 attaches to the free end of each arm 44 and is positioned under back support section 33*a***.

As viewed in FIG. 4, as motor 38 is energized to drive inner tube 39 into outer tube 41, arm 42 is pivoted counterclockwise around tube 43 and this causes arms 44 to rotate counterclockwise such that rollers 47 roll toward the head end and support section **33*a* lowers. On the other hand, when motor 38 is controlled to rotate in the opposite direction tube 39 will telescope out of tube 41 and arm 42 will pivot clockwise, thereby causing rollers 47 to lift section 33*a* and increase its tilt angle relative to seat support 33*c*. The electrical circuitry for ciontrolling motor 38** may also take any appropriate form such as that shown in either one of the aforementioned U.S. patents. Preferably, the operation of this circuitry will be under the control of the patient by means of the remote control unit that can either be hand held or removably attached to the bed. For example, safety sides or restraining sides may be mounted on the bed and the remote control unit can be held in a holder which in turn is attached to one of the safety sides.

Figure 8:
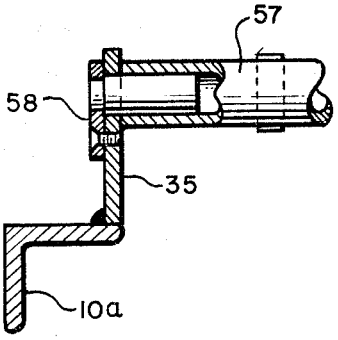
FIG. 8 is a fragmentary and partially broken away view taken along the section line 8—8 in FIG. 7; and, FIG. 9 is a fragmentary perspective view of a portion of the bed.

Secondary back support section **33*b* may be tilted upward by energizing a reversible or bi-directional motor 51 (best seen in FIGS. 5 and 6) which is hung from and supported by tube 52 the ends of which are rigidly affixed to side rails 10*a*. Rotation of motor 51 causes the inner telescoping tube 53 to move axially within outer tube 54. The free end of tube 53 pivotally connects to a pair of lever arms 56 which in turn are rigidly affixed to a pivot tube 57 rotatably mounted to brackets 35. FIG. 8 shows in detail one manner in which tube 57 may be pivotally coupled to bracket 35. A pivot stud 58 inserts through a hole in the bracket and extends into tube 57. Back support 33*b* is rigidly affixed to pivot tube 57 in order that its position will be determined by the position of arms 56. To explain, when motor 51 rotates in one direction tube 53 will be drawn into tube 54 and lever arms 56 will pivot around tube 57 in clockwise direction (as viewed in FIG. 5), thereby tilting back support section 33*b* upward. When the motor is reversed, tube 53 will telescope out of tube 54 and arms 56 will pivot counterclockwise to lower the position of secton 33*b*. Once again, appropriate electrical circuitry for controlling motor 51 may be found in anyone of the aforementioned patents. The circuitry may, in turn, be operated under the control of the remote control device. However, as will be seen the tilting of section 33*b* will usually be accomplished by the doctor or nurse rather than the patient. Hence, switches may be mounted on foot end panel 10*d*** for the convenience of the doctor or nurse.

Two mattresses 61 and 62 (see FIG. 1) are needed to cover the entire mattress supporting structure. Mattress 61 overlies primary back support section **33*a* and a portion of seat support section 33*c*, while mattress 62, which is articulated, overlies secondary back support section 33*b* and seat support section 33*d***.

In operation, the four sections **33*a*–33*d* are normally coplanar so that the two mattresses are likewise coplanar. Moreover, foot board 31 is normally attached to the bed. The bed is now established in its labor operating mode and an expectant mother may occupy the entire bed while she is in labor. At this time, she may effect the operation of motor 38 to tilt the primary back support section 33***a* upward (as in FIGS. 3 and 4) so that her back and head may be raised to the most comfortable position. Frame 10 may also be vertically adjusted (by operating motor 26) to raise or lower the entire mattress supporting structure to a desired level.

When delivery is imminent, foot board 31 is removed and the patient moves, or is moved, to the foot end of the bed with her buttocks resting on the portion of mattress 62 that covers seat support section 33*d*. In other words, her buttocks will now be supported by section 33*d*. The nurse or doctor then operates the circuitry that controls the energizing of motor 51 in order to tilt the secondary back support section 33*b* upward to place the patient in a semi-sitting position which will be optimum for delivery. Specifically, it has been found that a tilt angle of approximately 45° will place the patient's body in an ideal configuration for delivery. After section 33*b* is raised, head rest 63 is attached to section 33*b* by inserting tubes 63*a* into sockets 64, see FIGS. 2, 5 and 6. Head rest 63 enhances the support of the patient's head during delivery. Of course, mattress 62 has a portion that extends toward the head end in order to cover head rest 63. Moreover, mattress 61 is cut-a-away at its foot end in order to mate with the extended portion of mattress 62. The high-low motor 26 may also be operated to establish the patient at an optimum vertical level for childbirth.

Figure 9:
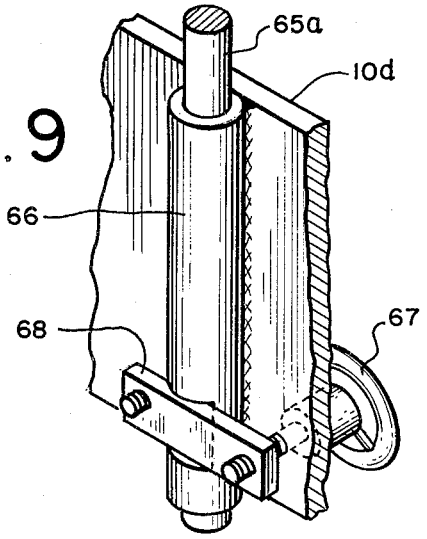

To complete the establishment of the hospital bed in the delivery mode, a pair of adjustable leg crutches 65 (see FIGS. 1, 2, 5, 6 and 9) are mounted at the foot end of the bed and are adjusted to support the patient's legs at an elevated level. Specifically, the shafts 65*a* of the crutches are inserted into sockets 66 rigidly affixed to end panel 10*d*. Four sockets are provided to permit the bed to be used for patients of a wide variety of shapes and sizes. Crutches 65 may also be set at any level and orientation by means of rotatable locking wheels 67 and holding brackets 68, see FIG. 9 in particular. A still wider range of patients with longer legs may be comfortably accommodated by spacing the holders for shafts 65*a* away from end panel 10*d*. It has been found that by mounting the shafts 65*a* up to ten inches from panel 10*d*, essentially any size pregnant patient can be comfortably held.

The bed has therefore effectively been converted from a somewhat conventional hospital bed to an obstetrical table. After the delivery process is concluded and the child is born, the same bed may then be used by the patient for recovery. This is achieved by returning the bed to its condition during labor. In other words, crutches 65 are removed, section 33*b* is lowered so that it will be flush with sections 33*c* and 33*d*, and foot board 31 is attached. The patient may then occupy the entire bed and can adjust back support section 33*a* as she desires to maximize her comfort.

It should now be apparent that the invention does not require two seat support sections in the mattress supporting structure as is the case in the illustrated embodiment. Only the seat section 33*d* at the foot end is needed. Section 33*c* may be eliminated and section 33*b* may be extended so that it meets section 33*a*. In fact, with a longer section 33*b* head rest 63 would not be necessary and each of the two mattresses could be rectangular shaped.

In accordance with another variation of the invention, each of the two mattresses may be rectangular shaped and head rest 63 may be padded or a separate pillow may be placed on the head rest. With this arrangement, mattresses 61 and 62 would meet along a straight line. By eliminating the cutout in mattress 61, the patient's comfort during labor and recovery will be enhanced.

It is also to be recognized that the various adjustments need not be motor driven. For example, hand operated cranks may be employed to effect tilting of sections 33*a* and 33*b* and raising of frame 10.

While a particular embodiment of the invention has been shown and described, modifications may be made, and it is intended in the appended claims to cover all such modifications as may fall within the true spirit and scope of the invention.

We claim:

1. An adjustable multiple-use labor-delivery-recovery hospital bed to be used by a pregnant patient during the labor, delivery and recovery phases of childbirth, comprising:

a frame;

a mattress supporting structure mounted on said frame and having, from its head end to its foot end and in the order named, a separate primary back support section, a separate secondary back support section, and a separate seat support section, the three support sections normally being coplanar;

first adjusting means for tilting said separate primary back support section upward during either said labor or recovery phases to raise the patient's back and head while the patient is in a reclining position and occupying substantially the entire bed;

second adjusting means for tilting said separate secondary back support section upward during the delivery phase to raise the patient's back and head after the patient is seated on said separate seat support section;

and a pair of leg crutches at the foot end of the bed for supporting the patient's legs at an elevated level during delivery.

2. An adjustable labor-delivery-recovery hospital bed according to claim 1 wherein said mattress supporting structure includes another separate seat support section between said primary and secondary back support sections and coplanar with said first-mentioned seat support section.

3. An adjustable labor-delivery-recovery hospital bed according to claim 1 wherein said crutches are mounted on said frame.

4. An adjustable labor-delivery-recovery hospital bed according to claim 1 wherein said frame is vertically adjustable in order to raise or lower the entire mattress supporting structure to a desired level.

5. An adjustable labor-dellivery-recovery hospital bed according to claim 1 wherein each of said support sections, in said mattress supporting structure, is essentially a perforated metal panel.

6. An adjustable multiple-use labor-delivery-recovery hospital bed to be used by a pregnant patient during the labor, delivery and recovery phases of childbirth, comprising:

a frame;

a mattress supporting structure mounted on said frame and having, from its head end to its foot end and in the order named, a separate primary back support section, a separate secondary back support section, and a separate seat support section, the three support sections normally being coplanar;

a first mattress overlying at least a major portion of said separate primary back support section;

a second mattress overlying at least a major portion of said separate secondary back support section, the patient occupying substantially the entire bed and lying on both of said mattresses during labor, whereas when delivery is imminent the patient moves to the foot end of the bed with her buttocks being supported by said separate seat support section;

first adjusting means for tilting said separate primary back support section upward so that the patient's back and head may be raised to the most comfortable postion while she is in labor;

and second adjusting means for tilting said separate secondary back support section upward in order to optimize the position of the patient for delivery.

7. An adjustable labor-delivery-recovery hospital bed according to claim 6 wherein said second mattress also overlies at least a major portion of said seat support section.

8. An adjustable labor-delivery-recovery hospital bed according to claim 6 and including a head rest, detachably secured to said separate secondary back support section when in its tilted position, for enhancing the support of the patient's head during delivery.

9. An adjustable labor-delivery-recovery hospital bed according to claim 8 wherein said second mattress has a portion that extends toward the head end of the bed and covers said head rest when attached to said secondary back support section, and wherein said first mattress is cut-a-way at its foot end in order to meet with the extended portion of said second mattres.

10. An adjustable multiple-use labor-delivery-recovery hospital bed to be used by a pregnant patient during the labor, delivery and recovery phases of childbirth, comprising:

a frame;

a mattress supporting structure mounted on said frame and having, from its head end to its foot end and in the order named, a separate primary back support section, a separate secondary back support section, and a separate seat support section, the three support sections normally being coplanar;

first motor-driven adjusting means for tilting said separate primary back support section upward during either said labor or recovery phases to raise the patient's back and head while the patient is in a reclining position and occupying substantially the entire bed;

and second motor-driven adjusting means for tilting said separate secondary back support section upward during the delivery phase to raise the patient's back and head after the patient is seated on said separate seat support section.

* * * * *

UNITED STATES PATENT OFFICE

CERTIFICATE OF CORRECTION

PATENT NO. : 4,247,091

DATED : January 27, 1981

INVENTOR(S) : GERALD A. GLOWACKI and DAVID E. CAGE

It is certified that error appears in the above-identified patent and that said Letters Patent are hereby corrected as shown below:

Correct the spelling of the attorney's name so that it reads: JAMES E. TRACY.

Signed and Sealed this

Nineteenth Day of May 1981

[SEAL]

*Attest:*

RENE D. TEGTMEYER

*Attesting Officer*

*Acting Commissioner of Patents and Trademarks*